US007872518B2

(12) United States Patent
Weder et al.

(10) Patent No.: US 7,872,518 B2
(45) Date of Patent: Jan. 18, 2011

(54) CIRCUIT AND METHOD FOR DETECTING, WHETHER A VOLTAGE DIFFERENCE BETWEEN TWO VOLTAGES IS BELOW A DESIRED VOLTAGE DIFFERENCE, AND PROTECTION CIRCUIT

(75) Inventors: Uwe Weder, Au / Hallertau (DE); Christoph Mayerl, Munich (DE); Julia Kresse, Munich (DE); Christoph Saas, Munich (DE); Dennis Tischendorf, Unterhaching (DE)

(73) Assignee: Infineon Technologies AG, Neubiberg (DE)

( * ) Notice: Subject to any disclaimer, the term of this patent is extended or adjusted under 35 U.S.C. 154(b) by 14 days.

(21) Appl. No.: 12/183,225

(22) Filed: Jul. 31, 2008

(65) Prior Publication Data

US 2010/0026377 A1 Feb. 4, 2010

(51) Int. Cl.
*G05G 1/10* (2006.01)
*G05F 3/02* (2006.01)

(52) U.S. Cl. ..... 327/540

(58) Field of Classification Search ..... 327/72, 327/73, 540, 541, 542, 543
See application file for complete search history.

(56) References Cited

U.S. PATENT DOCUMENTS

| | | | | |
|---|---|---|---|---|
| 5,059,888 | A | 10/1991 | Van Tuijl et al. | |
| 6,573,768 | B2 * | 6/2003 | Hwang | 327/143 |
| 7,502,719 | B2 * | 3/2009 | Moraveji | 702/185 |
| 2002/0050854 | A1 | 5/2002 | Zha et al. | |
| 2008/0007321 | A1 * | 1/2008 | Castaldo et al. | 327/536 |

* cited by examiner

*Primary Examiner*—Lincoln Donovan
*Assistant Examiner*—Daniel Rojas
(74) *Attorney, Agent, or Firm*—Dickstein Shapiro LLP

(57) ABSTRACT

A circuit for detecting, whether a voltage difference is below a desired voltage difference comprises a voltage shift resistor, a current provider and a detection circuit. The current provider provides a current flowing through the voltage shift resistor such that the desired voltage difference across the voltage shift resistor is determined by a reference signal. The detection circuit is configured to compare a first voltage at a first input with a voltage at a second input to obtain a signal. The voltage shift resistor is coupled between a conductor for a second voltage and the second input, such that the voltage at the second input differs from the second voltage by the desired voltage difference, and wherein the detection circuit is configured to provide the signal, such that the signal indicates, whether the voltage difference between the first and the second voltage is below the desired voltage difference.

10 Claims, 9 Drawing Sheets

CIRCUIT AND METHOD FOR DETECTING, WHETHER A VOLTAGE DIFFERENCE BETWEEN TWO VOLTAGES IS BELOW A DESIRED VOLTAGE DIFFERENCE, AND PROTECTION CIRCUIT

BACKGROUND

Embodiments according to the invention relate to a circuit and a method for providing a desired voltage difference in dependence on a reference voltage.

For measurement, control, protection or other purposes it can be desirable to provide predetermined voltage differences.

SUMMARY OF THE INVENTION

Embodiments of the invention provide a circuit for providing a desired voltage difference in dependence on a reference signal, the circuit comprising: A first resistor; a second resistor; a regulation circuit configured to regulate a current flowing through the first resistor, such that a voltage difference across the first resistor is determined by the reference signal; and a current mirror, wherein the current mirror is configured to mirror the current flowing through the first resistor to obtain a mirrored current flowing through the second resistor, such that the desired voltage difference is obtained across the second resistor.

Further embodiments according to the invention create a method for providing a desired voltage difference in dependence on a reference signal, a circuit for detecting, whether a voltage difference between two voltages is below a desired voltage difference, and a protection circuit.

BRIEF DESCRIPTION OF THE DRAWINGS

Embodiments of the circuits and method are described hereinafter, making reference to the appended drawings.

DETAILED DESCRIPTION OF THE DRAWINGS

In the following, equal features or features providing the same or similar functionality are referred to by the same reference signs.

The term "voltage" can also be referred to as "potential" or "voltage potential" and the term "voltage difference" also as "potential difference" or "voltage potential difference". In the following description, voltages are described with respect to a reference voltage.

Embodiments of the circuits may comprise transistors of any transistor technology, for example field-effect transistor technology (FET) or bipolar transistor technology. Therefore, the following technology-independent terms are used for describing the respective transistor terminals: "control terminal" designates a gate terminal or base terminal, "source terminal" designates a source terminal or emitter terminal, and "sink terminal" designates a drain terminal or a collector terminal.

Figure 1:
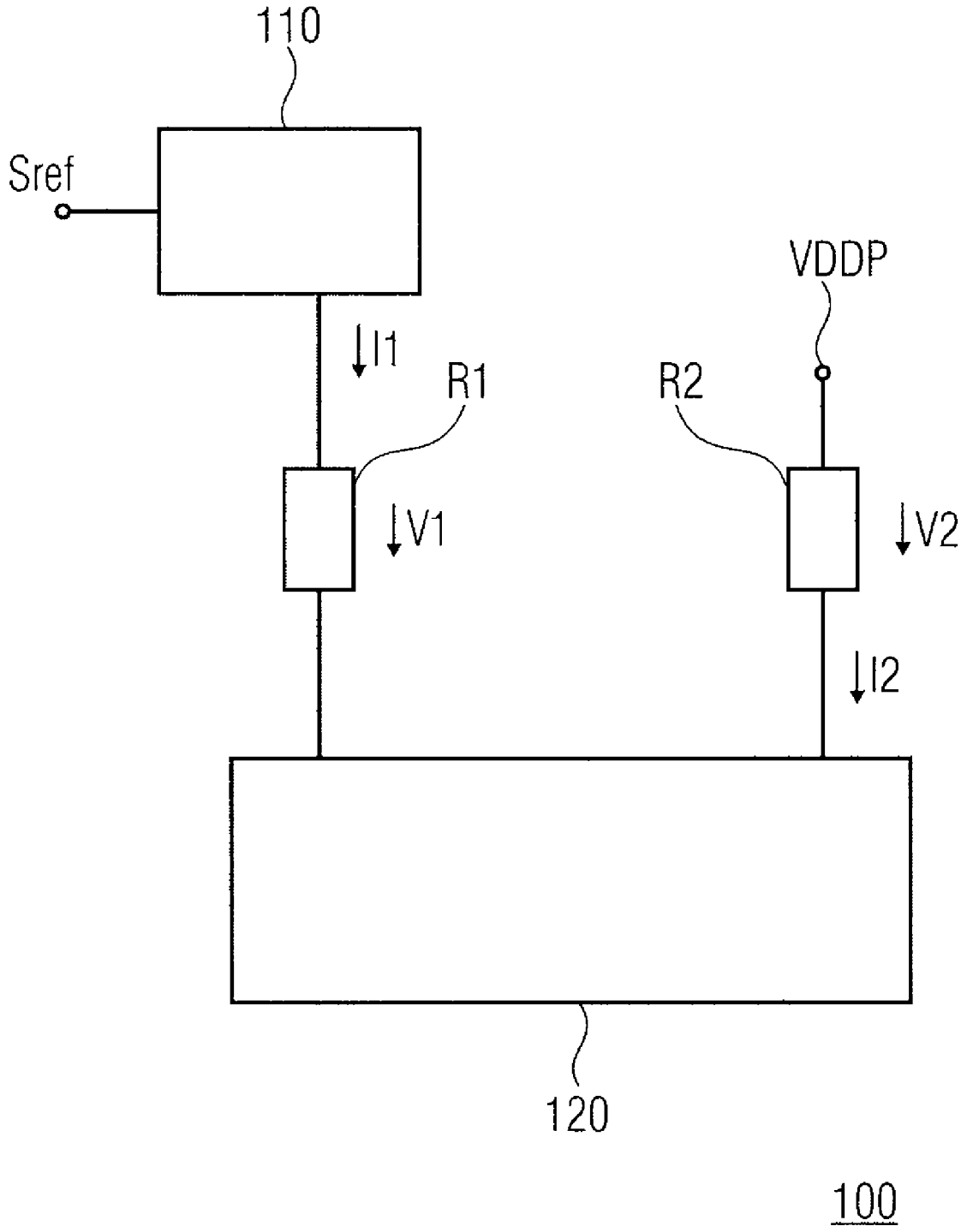
FIG. 1 shows a block diagram of an embodiment of a circuit for providing a desired voltage difference.

FIG. 1 shows a block diagram of an embodiment of a circuit 100 for providing a desired voltage difference V2 in dependence on a reference signal Sref. The circuit comprises a first resistor R1, a second resistor R2, a regulation circuit 110 and a current mirror 120. The regulation circuit is configured to regulate a current I1 flowing through the first resistor R1, such that a voltage difference V1 across the first resistor R1 is determined by the reference signal Sref. The current mirror 120 is configured to mirror the current I1 flowing through the first resistor R1 to obtain a mirrored current I2 flowing through the second resistor R2, such that the desired voltage difference V2 is obtained across the second resistor R2.

The mirrored current I2 flowing through the second resistor is proportional to the current I1 flowing through the first resistor R1. Thus, by generating a current I1 dependent on the reference signal Sref, a desired voltage difference V2, which is proportional to the voltage difference V1 across the first resistor R1, is generated.

As shown in FIG. 1, one contact of the second resistor R2 is coupled to the current mirror 120. In case the other contact of the second resistor R2 is coupled to a voltage, for example VDDP, a desired voltage difference V2 is essentially independent of such voltage VDDP.

Embodiments of the circuit 100 can therefore be used for measurement, protection or other purposes, where a desired voltage difference V2 is required, which is essentially independent of a voltage VDDP.

In the following, an embodiment of a circuit 100 for providing a desired voltage difference V2 is described in more detail based on FIG. 2.

Figure 2:
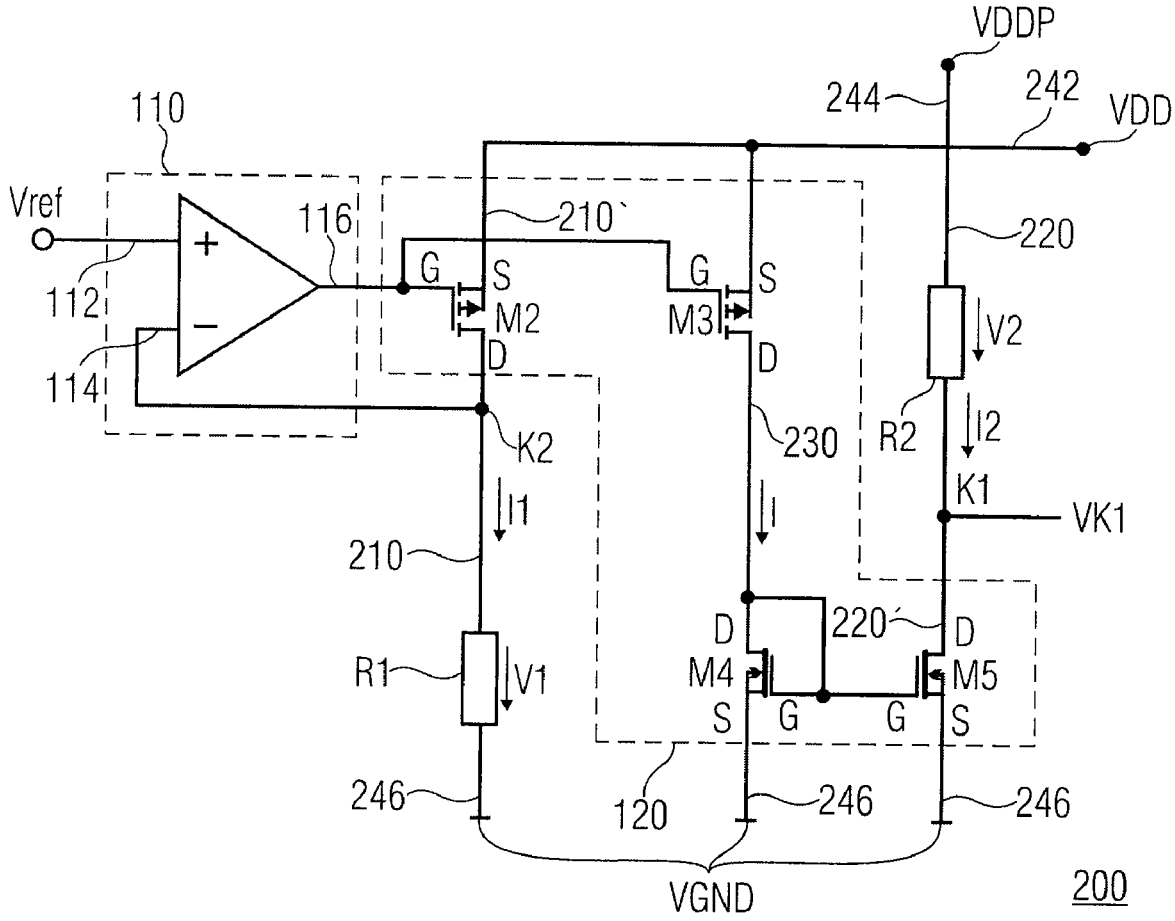
FIG. 2 shows a circuit diagram of an embodiment of a circuit for providing a desired voltage difference.

FIG. 2 shows an embodiment of a circuit 200 for providing a desired voltage difference in dependence on a reference signal comprising a first resistor R1, a second resistor R2, a regulation circuit 110 and a current mirror 120. The circuit 200 comprises a first current path 210, a second current path 220 and a third current path 230. The current mirror 120 comprises a first transistor M2, a second transistor M3, a third transistor M4 and fourth transistor M5.

The circuit 200 further comprises a first conductor 242 for applying a first voltage VDD, a second conductor 244 for applying a second voltage VDDP and a third conductor 246 for applying a third voltage VGND. The potential of the third conductor may serve as a reference potential.

The regulation circuit 110 comprises a first input terminal 112, a second input terminal 114, and an output terminal 116. A reference voltage Vref can be applied to the first input terminal 112 as reference signal Sref. The second input terminal 114 is coupled to a node K2, which is arranged between the first transistor M2 and the first resistor R2, which are arranged and coupled in series on the first current path 210. The output terminal 116 of the regulation circuit 110 is coupled to a control terminal G of transistor M2 and to a control terminal G of transistor M3.

The regulation circuit 110 can, for example, be a comparator or an operational amplifier, wherein the first input terminal forms the non-inverting input terminal and the second input terminal 114 forms the inverting input terminal.

The first current path 210 comprises the first transistor M2 (e.g. a p-channel MOS-FET) and the first resistor R1. A load path of the transistor M2 and the first resistor R1 are coupled in series to each other, wherein the sink terminal D or drain terminal D (MOS-FET) of the transistor M2 is connected to one terminal of the first resistor R1, whereas the other terminal of resistor R1 is coupled to the third conductor for the third voltage VGND.

The second current path 220 comprises the second resistor R2 and the fourth transistor MS (e.g. a n-channel MOS-FET). A load path of the fourth transistor MS and the second resistor R2 are coupled in series on the second current path, wherein a sink terminal D or drain terminal D (MOS-FET) of the fourth transistor MS is connected to one terminal of the second resistor R2, and the other terminal of the second resistor R2 is coupled to the second conductor 244 for the second voltage VDDP.

The third or further current path 230 comprises the second transistor M3 (e.g. a p-channel MOS-FET) and the third transistor M4 (e.g. a n-channel MOS-FET). A load path of second transistor M3 and the third transistor M4 are connected in series to each other on the third current path, wherein a sink terminal or draine terminal D (MOS-FET) D of the second transistor M3 is connected to a sink terminal D or drain terminal D (MOS-FET) D of the third transistor M4 and to a control terminal G or gate terminal G (MOS-FET) of the third transistor M4, wherein the control terminal G is again coupled to a control terminal G or gate terminal G (MOS-FET) of the fourth transistor M4. In other words, the third and fourth transistors M4, M5 form a two-transistor current mirror, which forms a part of the four-transistor current mirror 120.

A source terminal S of the first transistor M2 and a source terminal S of the second transistor M3 are electrically coupled to each other and to the first conductor 242 for applying the first voltage VDD. A source terminal S of the third transistor M4, a source terminal S of the third transistor M4, a source terminal S of the fourth transistor M5 and the contact-terminal of the first resistor, which is not connected to the sink terminal of the first transistor M2, are connected to each other and to a third conductor 246 for applying a third voltage VGND, for example ground GND.

The regulation circuit 110 is configured to compare the voltages at the first and the second input terminal 112, 114, i.e. the reference voltage Vref and the voltage at node K2 and to provide an output voltage 116, or more general, an output signal, which depends on the difference between the voltage applied to the first input terminal 112 and to the voltage applied to the second input terminal 114. The regulation circuit 110 is configured to control the output voltage output at the output terminal and provided to the gate G of transistor M2, such that a difference between the voltages applied to the first input terminal 112 and the second input terminal 114 is reduced below a voltage difference threshold, which is typically specific to the particular regulation circuit used. In an ideal case, the regulation circuit 110 is configured to minimize the voltage difference between the two input terminals, such that the voltage at the second input terminal and at node K2 respectively is essentially equal to the reference voltage Vref. In other words, the voltage difference V1 across the first resistor R1 is regulated such that it essentially equals to the reference voltage Vref.

The output voltage of the regulation circuit 110 is applied to the control terminals G of the first transistor M2 and the second transistor M3. Thus, a third or further current I is generated by the second transistor M3, which flows through the third transistor M4 and which is proportional to the current I1 flowing through the first resistor R1, i.e. $I=k23\cdot I1$, k23 being a proportionality factor.

The third transistor M4 and the fourth transistor MS form a two-transistor current mirror and are configured such that the mirrored current I2 flowing through the second resistor R2 is proportional to the current I flowing through the third transistor M4, i.e. $I2=k45\cdot I$ or $I2=k23\cdot k45\cdot I1$, k45 being the corresponding proportionality factor. The voltage drop across the second resistor is designated with V2. With $V2=R2\cdot I2$ and $V1=Vref=R1\cdot I1$, the equation for V2 can also written as $V2=R2/R1\cdot k23\cdot k45\cdot Vref$, and in case R1 is a multiple of R2, i.e. $R1=n\cdot R2$, it can also be written as $V2=1/n\cdot k23\cdot k45\cdot Vref$.

Thus, the voltage difference V2 can be determined—at least approximately independent of a second voltage VDDP applied to the second resistor R2—based on the reference voltage Vref, the ratio n of the first resistance R1 and the second resistance R2 and the proportionality factors k23 and k45.

Thus, embodiments of the circuit for providing a desired voltage difference in dependence on a reference signal or a voltage, can be easily adjusted to provide different desired voltage differences, e.g. for the same reference voltage Vref by adjusting the resistance values of the first resistor R1 and the second resistor R2 or their respective resistance ratio n.

Furthermore, in embodiments of integrated circuits 100, 200 for providing a desired voltage difference in dependence on a reference voltage, wherein the integrated circuit 100, 200 comprises two integrated polycrystalline resistors R1 and R2, also referred to as poly-resistors or polysilicon resistors, the absolute values of the poly-resistors R1, R2 may vary due to production tolerances from one production lot to another, however they will vary in the same manner, and thus, the ratio n of the resistance values of the first and second integrated poly-resistors R1 and R2 can be controlled very precisely and kept at the desired value despite of the production variations. The precise control of the ratio of the resistance values allows also a precise control of the desired voltage difference V2. Therefore, embodiments of the circuit 100, 200 have reduced or even negligible dependency and also reduced or even negligible temperature dependency with regard to the desired voltage difference V2.

In further embodiments, the first integrated resistor R1 and the second integrated resistor R2 comprise the same layer structure and differ only in their dimensions to provide the different resistance values.

Further embodiments of the circuit 100, 200 comprise a bandgap reference circuit, which provides a very accurate reference voltage Vref, for example at 1.2 V, which can be connected to the first terminal 112 of the regulation circuit 110 to provide the reference voltage Vref. Such embodiments provide a further temperature independence as bandgap reference circuits provide the reference voltage almost independent with regard to their temperature, i.e. provide a temperature coefficient of almost 0.

In FIG. 2, the second current path 210 comprises a node K1 with a voltage VK1, wherein the voltage difference between the second voltage VDDP of the second conductor 244 and the voltage VK1 of the node K1 is equal to the desired voltage difference V2 across the second resistor R2.

In further embodiments, the first transistor M2 and the second transistor M3 may comprise the same structure or layer structure and only differ in their dimensions to provide different current levels in the first and third current paths (k23< >1) or may even comprise the same dimensions to provide the same current levels in the first and third current paths (k23=1). Similar, the third transistor M4 and the fourth transistor M5 may comprise the same structure or layout structure with regard to each other and may only differ in their dimensions to provide different current levels in the second and third current path 220, 230 (k45< >1) or may even comprise the same dimensions to provide the same current level for the second current path 220 and the third current path 230 (k45=1).

Embodiments of the circuit 200 may also be described alternatively as a circuit 200, wherein the current mirror 120 comprises a first current path 210', a second current path 220' and a third current path 230, wherein the first current path comprises a transistor M2 coupled to the first resistor R1 to provide the current I1 flowing through the first resistor R1, wherein the third current path 230 comprises a second transistor M3 and a third transistor M4, wherein the second current path 220' comprises a fourth transistor M5 coupled to the second resistor to provide the mirrored current flowing through the second resistor, wherein the first transistor M2 and the second transistor M3 are configured, such that the current I flowing through the third current path is proportional to a current I1 flowing through the first resistor; and wherein the third transistor M4 and the fourth transistor M5 are configured, such that the mirrored current I2 flowing through the second resistor R2 is proportional to the current I flowing through the third current path.

Further embodiments of the circuit 200 comprise a regulation circuit 110, which is configured to regulate the current I1 flowing through the first resistor R1 by regulating a voltage applied to a control terminal G of the first transistor M2, and wherein the regulation circuit 110 is further configured to regulate a voltage applied to a control terminal G of the second transistor M3, and wherein a source terminal S of the first transistor M2 and a source terminal of the second transistor M3 are connected to each other.

FIG. 2 shows an embodiment of the circuit 200, wherein the same voltage is applied to a control terminal G of the transistors M2 and M3. In other embodiments, the regulation circuit 110 can be configured to provide different voltages to the control terminal G of the first transistor and to the control terminal G of the second transistor, wherein these different voltages are dimensioned such that the third current I is proportional to the current I1 flowing through the first resistor R1.

Further embodiments of the circuit 200 comprise a regulation circuit, which is configured to compare a reference voltage Vref of the reference signal Sref and a voltage obtained from a node K2 arranged between the first transistor M2 and the first resistor R1, and to regulate the voltage applied to the control terminal G of the first transistor M2 based on the comparison, such that a difference between the reference voltage Vref and the voltage obtained from the node K2 is reduced below a given threshold.

Figure 3:
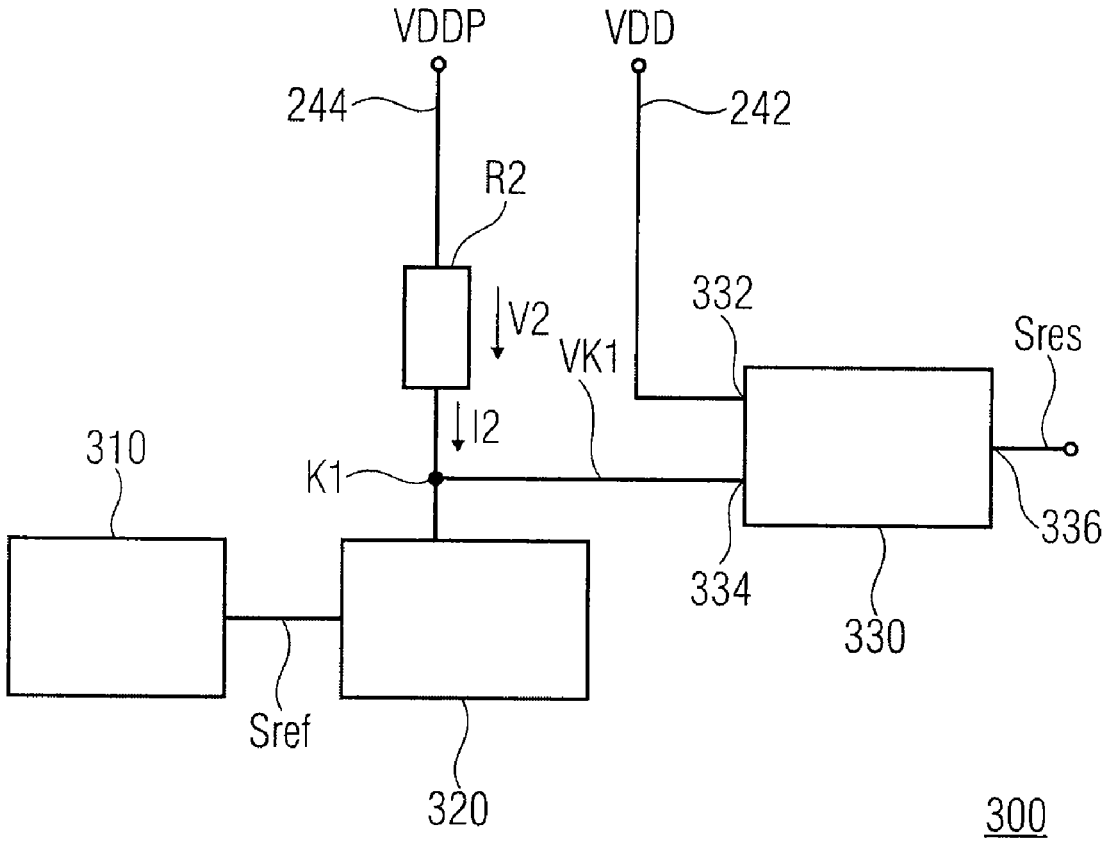
FIG. 3 shows a block diagram of an embodiment of a circuit for detecting whether a voltage difference between two voltages is below a desired voltage difference.

FIG. 3 shows a block diagram of an embodiment of a circuit 300 for detecting whether a voltage difference between two voltages, VDDP and VDD, is below a desired voltage V2. The circuit 300 comprises a reference circuit 310, a voltage shift resistor R2, a current provider 320 and a detection circuit 330. The reference circuit 310 is configured to provide a reference signal Sref.

The current provider 320 is configured to receive the reference signal Sref and to provide a regulated current I2 flowing through the voltage shift resistor R2 based on the reference signal Sref, wherein the current provider 320 is configured to regulate the regulated current I2, such that the desired voltage difference V2 across the voltage shift resistor R2 is determined by the reference signal Sref.

The detection circuit 330 comprises a first input terminal 332 and a second input terminal 334 and is configured to compare a voltage at a first voltage detection circuit input 332 with a voltage at the second voltage detection circuit input 334 to obtain a comparison result signal Sres, wherein the first voltage detection circuit input 332 is coupled to a first conductor 242 for a first voltage VDD of the two voltages, wherein the voltage shift resistor R2 is coupled between a second conductor 244 for a second voltage VDDP of the two voltages and the second voltage detection circuit input 334, such that the voltage at the second voltage detection circuit input 334 differs from the second voltage VDDP by the desired voltage difference V2, and wherein the detection circuit 330 is configured to provide the comparison result signal Sres, such that the comparison result signal indicates, whether the voltage difference "VDDP−VDD" between the second voltage VDDP and the first voltage VDD is below the desired voltage difference V2.

As shown in FIG. 3, the second comparator input 334 can be coupled to a node K1, which is connected in series between a contact of the second resistor R2 and the current provider 320, and wherein the other contact of the second resistor R2 is connected to the second conductor 244 for the second voltage VDDP. The voltage at node K1 is also referred to as VK1 and can be defined as VK1=VDDP−V2.

For embodiments, where the comparison result signal Sres is a comparison result voltage Vres, which is defined as Vres=VK1−VDD, the comparison result voltage Vres will change its sign, from a positive sign to a negative sign, as soon as the difference between the second voltage VDDP and the first voltage VDD is smaller than the desired voltage difference V2, i.e. VDDP−VDD<V2.

Thus, embodiments of a circuit 300 provide an efficient means for detecting whether a voltage difference between a first voltage VDD and a second voltage VDDP is below a desired voltage difference V2, wherein the desired voltage difference V2 is provided by a regulated current I2 flowing through a voltage shift resistor R2 and the regulated current is determined based on a reference signal Sref or a reference voltage Vref.

As explained based on FIGS. 1 and 2, the desired voltage difference V2 can thus be set essentially independent of the second voltage VDDP and embodiments of the circuit 300 can offer the same effects as explained for the circuits 100 and 200.

Embodiments of the circuit 300 may comprise, for example, a band reference circuit as reference circuit 310 to provide a reference voltage Vref as reference signal Sref.

A more detailed embodiment of a circuit 400 for detecting whether a voltage difference between a first voltage and a second voltage is below a desired voltage difference is described based on FIG. 4.

Figure 4:
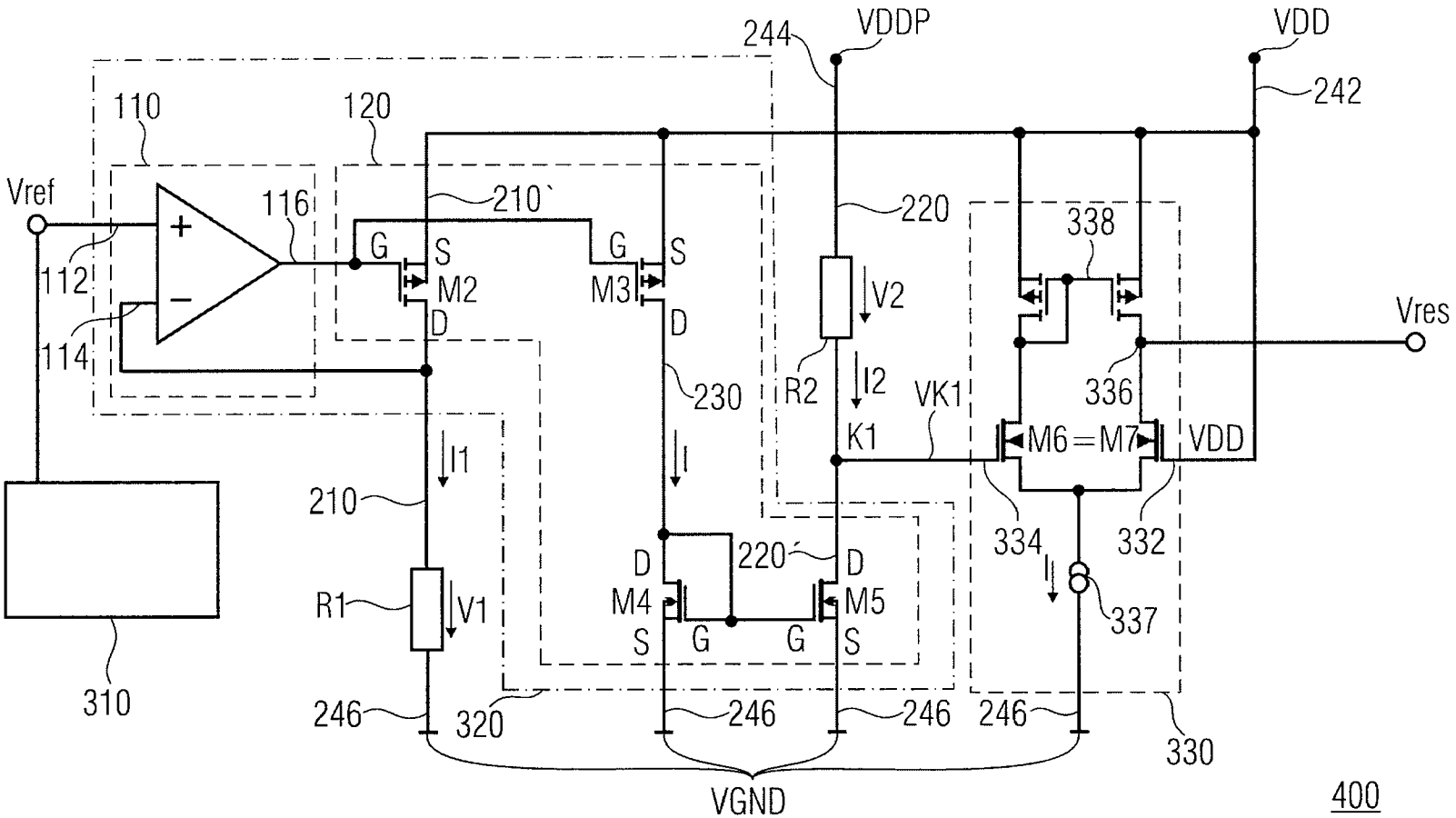
FIG. 4 shows a circuit diagram of an embodiment of a circuit for detecting whether a voltage difference between two voltages is below a desired voltage difference.

FIG. 4 shows an embodiment of a circuit 400 for detecting, which is similar to the embodiment of a circuit 200 for providing a desired voltage difference V2. Embodiments of the circuit 400 comprise additionally—compared to embodiments of circuit 200—a reference circuit 310 to provide a reference voltage Vref to the first input terminal of the regulation circuit 110, and a detection circuit 330.

The detection circuit 330 comprises a comparator as detection circuit 330, the comparator comprising two identical transistors M6 and M7, wherein the two transistors M6 and M7 are connected in parallel to each other to a current source 336 and to a two-transistor current mirror 338 and a detection circuit output respectively comparator output 336. The gate of the transistor M7 forms the first detection circuit input or comparator input 332 and the gate of the transistor M6 forms the second detection circuit input or second comparator input 334.

As already explained based on the FIGS. 1 to 3, embodiments of a circuit 400 can offer a reduced process dependency and a reduced temperature dependency with regard to its circuit characteristics and in particular with regard to the desired voltage difference V2 and accordingly with regard to the measurement of the difference between the second voltage VDDP and the first voltage VDD.

Figure 5:
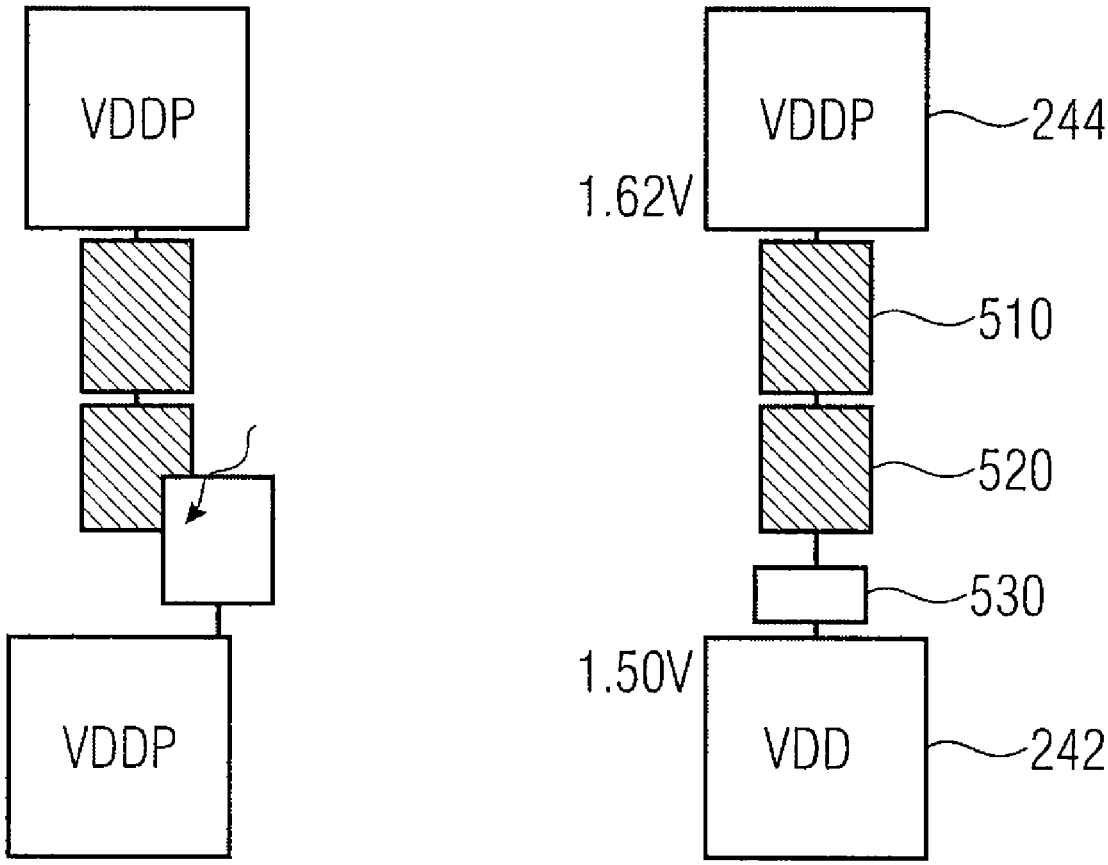
FIG. 5 shows a schematic diagram of an external and an internal voltage domain of a multi-voltage-domain circuit and the respective voltage regions.

FIG. 5 shows a schematic diagram of an external voltage domain 244 and an internal voltage domain 242 as can be found in integrated circuits with different voltage domains, wherein the internal voltage domain 242 is generated or powered using an n-channel series regulator. The difference between the external voltage VDDP of the external voltage domain 244 and the internal voltage VDD of the internal voltage domain 242 is very small, e.g. according to an ISO-Norm, only 0, 12V, wherein the external voltage VDDP is 1.62V and the internal voltage VDD is 1.50V. Within this small voltage region between the external and the internal voltage the following non-overlapping voltage regions are required (see FIG. 5, right handside): an external voltage sensor region 510, a verification region 520 for the external voltage sensor, and an overvoltage protection region 530.

Figure 6:
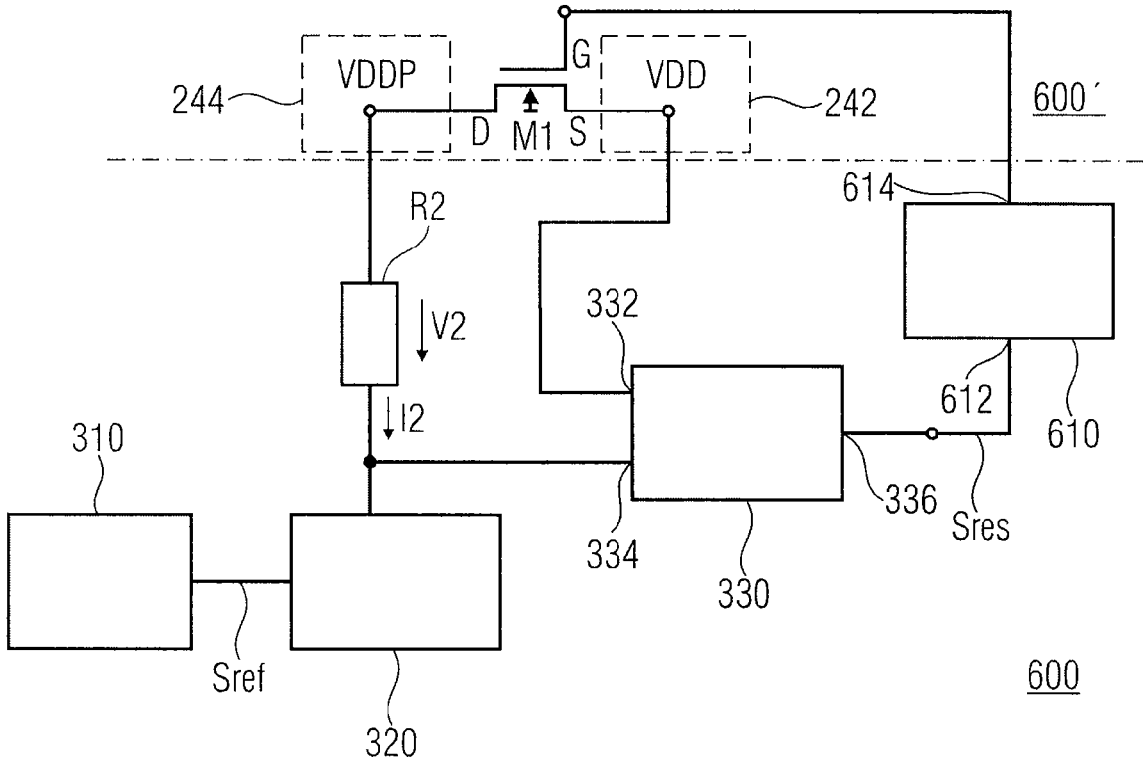
FIG. 6 shows a block diagram of an embodiment of a protection circuit for protecting a first or internal voltage domain.

FIG. 6 shows in the upper part thereof a circuit 600' (above the hash-dotted line) comprising the aforementioned first voltage domain 242, which is coupled to a second voltage domain 244 via a series transistor M1. The first or internal voltage domain 242 may comprise only a conductor 242 or one or a plurality of integrated circuit elements, which are designed to be operated by the first or internal voltage VDD. Similarly, the second or external voltage domain may comprise only a conductor 244 or one or a plurality of integrated circuit elements, which are configured to be operated at the second or external voltage VDDP.

At small drain-source-voltages (VDDP−VDD) the n-channel voltage regulation transistor M1 changes from the saturation region into the ohmic region and the control terminal G of the regulation transistor M1 is pumped up such that the voltage at the control terminal G is increased. In the ohmic region external voltage spikes couple almost unattenuated on the internal voltage domain with the consequence that circuit parts, for example the thin gate oxide, are destroyed, and/or voltage spikes change the functionality, which is a risk for security controllers. The circuit should, furthermore, cover only a minimum of the surface area and may not be switched off, which leads to the requirement of an extremely low current consumption, for example smaller than 1 μA.

Asymmetric comparators are temperature-dependent, process-dependent, dependent on the comparator current and, thus, have a large spread of voltage differences (see, for example, the overvoltage protection region 530' in FIG. 5 overlapping with the verification region 520 for the external voltage sensor).

Non-inverting operational amplifiers generate output voltages which are larger than the internal voltage VDD. Therefore, the operational amplifier has to be connected to an external voltage supply. This leads to a large area consumption, e.g. due to the high voltage elements, and to a susceptance to failure with regard to the external voltage supply. Furthermore, an electrostatic discharge (ESD) protection is required.

Resistance or voltage dividers connected to an external voltage supply in combination with a comparator lead to large resistance areas due to the requirement of ultra-lower power supply.

The lower part of FIG. 6 shows an embodiment of a protection circuit 600 for protecting a first voltage domain, for example, an internal voltage domain 242, the first voltage domain 242 being coupled to a second voltage domain 244, for example an external voltage domain, via a series transistor M1.

The terms "internal" and "external" are used from the point of view of the "internal voltage domain" 242, and shall only indicate that typically the external voltage domain 244 comprises a higher voltage VDDP than the internal voltage domain 242 comprising a voltage VDD, or in other words, the external voltage domain 244 acts as power supply to the internal voltage domain 242.

The protection circuit 600 comprises, similar to the circuit 300 of FIG. 3, a reference circuit 310, a voltage shift resistor R2, a current provider 320 and a detection circuit 330. The protection circuit 600 comprises additionally a series transistor regulation circuit 610, which is configured to adapt the voltage or pumping of the control terminal G of the series transistor M1, such that a load path resistance of the drain-source path of the series transistor M1 is increased in case the detection circuit 330 provides a comparison result signal Sres to the series transistor regulation circuit 610 indicating that the voltage difference between the first voltage is below the desired voltage difference V2.

As can be seen from FIG. 6, the series transistor regulation circuit 610 has an input 612, which is coupled to the detection circuit output 336 to receive the comparison result signal Sres, and comprises an output 614, which is coupled to the control terminal G of the series transistor M1. Embodiments of the series transistor regulation circuit can comprise, for example, pump circuits which pump up the control terminal G of the series transistor, or a circuitry, which is configured to control the voltage applied to a control terminal G of the series transistor M1. Embodiments of the series transistor regulation circuit are configured to reduce or stop the pumping or to reduce the control voltage applied to the control terminal G of series transistor M1 to increase the load path resistance, when the voltage difference between the second voltage VDDP and the first voltage VDD is below the desired voltage difference V2, or in other words, when the series transistor is about to change into the ohmic region.

Further embodiments comprise a series transistor regulation circuit, which is configured to reduce the voltage applied to the control terminal or to reduce the pumping of the control terminal G of the series transistor M1 such that the series transistor is operated in its saturation region in case the voltage difference between the second voltage VDDP and the first voltage VDD is below the desired voltage difference V2, or when the series transistor is about to change into the ohmic region.

The desired voltage V2 can be set essentially independent of the external voltage VDDP, and precisely and essentially independent from production or temperature variations. Thus, embodiments of the protection circuit 600 provide an efficient means for protecting the first voltage domain VDD from current spikes as they allow for a very precise and production/temperature independent monitoring of the voltage difference between the second voltage VDDP and the first voltage VDD.

Figure 7:
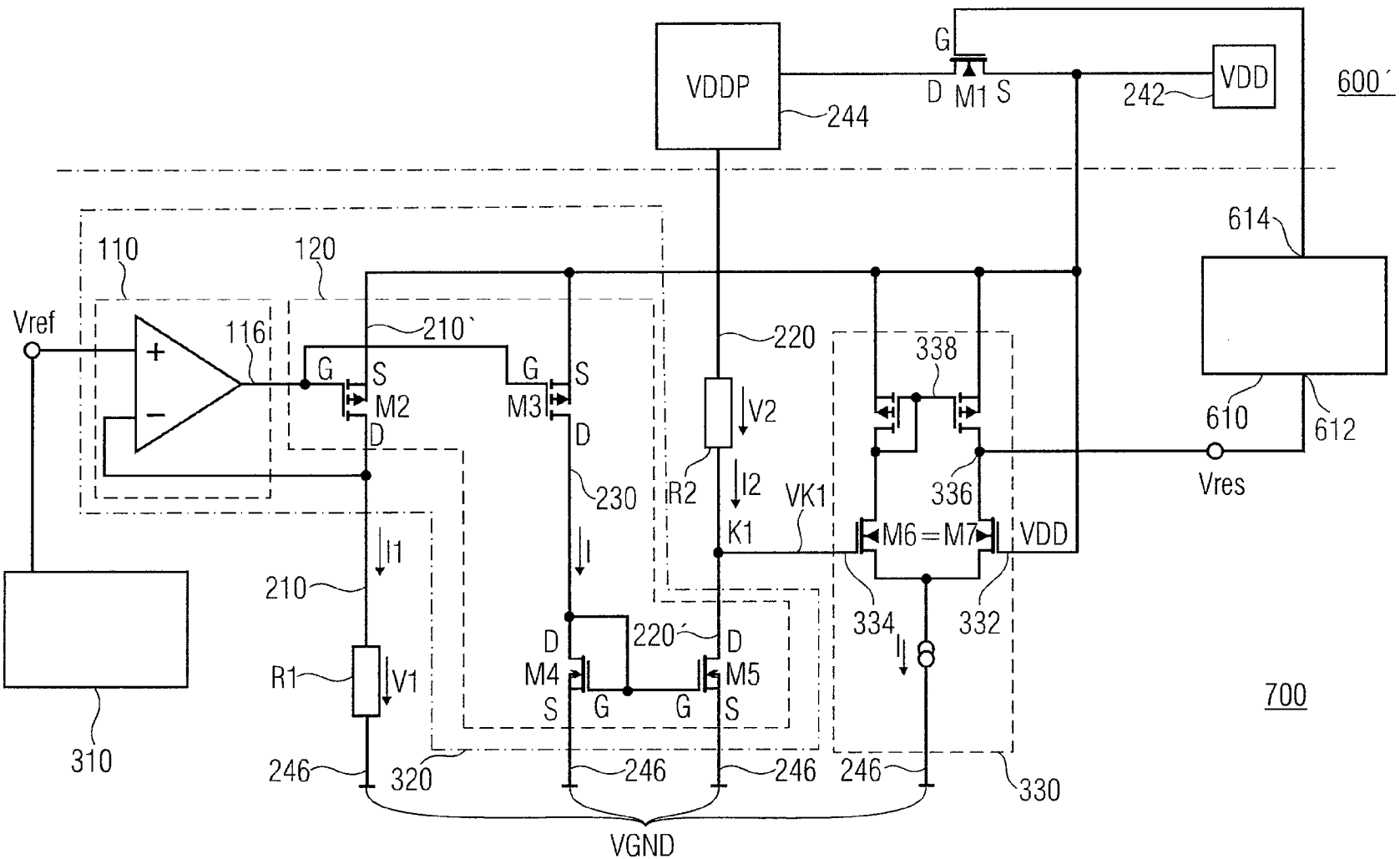
FIG. 7 shows a circuit diagram of an embodiment of a protection circuit for protecting a first or internal voltage domain.

A more detailed embodiment of a protection circuit 700 is described based on FIG. 7. The protection circuit 700 is similar to the circuit 400 for detecting, whether a voltage difference between two voltages is below a desired voltage difference, and comprises additionally the series transistor regulation circuit 610 as described based on FIG. 6.

The series transistor regulation circuit comprises an input terminal 612, which is coupled to the output terminal 336 of the comparator 330 to receive the comparison result voltage Vres, and comprises an output terminal 614, which is coupled to the control terminal G of the series transistor M1 to regulate the series transistor M1.

As already discussed based on FIG. 6, in one embodiment the series transistor regulation circuit 610 is configured to adapt the voltage applied to the control terminal G or to pump the control terminal G of the series transistor M1, such that a load path resistance of the series transistor is increased in case the comparison result signal Vres indicates that the voltage difference between the second voltage VDDP and the first voltage VDD is below the desired voltage difference V2. According to a further embodiment, the series transistor regulation circuit 610 is configured to adapt the voltage applied to the control terminal or to pump the control terminal of the series transistor M1, such that the series transistor is operated in its saturation region in case the comparison result voltage Vres indicates that the voltage difference is below a desired voltage difference V2.

Embodiments of the protection circuit 600, 700 provide a protection circuit, which protects the first or internal voltage domain 242 from, for example, current spikes, by precisely detecting, when the voltage difference between the second or external voltage domain 244 and the first or internal voltage domain 242 is below the desired voltage V2, wherein V2 defines the overvoltage protection area 530, as shown in FIG. 5.

Describing the protection circuit 700 in other words, a current I1 is generated across an integrated poly-resistor R1 using a high precision bandgap reference circuit 310 and a comparator 110. Absolute spreads of the resistance values of the poly-resistor lead to absolute spreads with regard to the current value of current I1. The current I1 is mirrored using the transistors M2-M5. With regard to the second or external voltage VDDP a high precision voltage drop is generated over a second integrated poly-resistor R2, wherein the resistance value of the poly-resistor R1 is a multiple of the resistance value of the poly-resistor R2, wherein the integrated poly-resistor R2 comprises the same spreads with regard to the resistance value, because the spreads of the resistance values of the resistors compensate each other. In other words, the absolute value of the poly-resistors R1 and R2 is very imprecise, however the ratio is very precise. Thus, a very precise voltage difference, for example 50 mV with regard to the second or external voltage VDDP can be generated.

The comparator 330 comprising two identical input transistors M6, M7 assesses the voltage at node K1. The comparison result signal Sres causes measures like, for example, pump stop or reducing the gate voltage of the gate of the series transistor M1, which prevents a change of the series transistor M1 into the ohmic region.

Protection circuits 600, 700 using a bandgap reference circuit 310 depend solely on the bandgap reference voltage, for example 1.2 V, but not from any other further integrated spreading component, which would be inevitable imprecise. Unavoidable variations of the absolute values of the resistors R1 and R2 compensate each other due to the circuit technology as already described. The bandgap reference provides a very precise absolute reference value on silicon. The whole comparison and protection circuit references only to the first or internal voltage domain. Therefore, a very precise setting of a voltage difference V2 with regard to the second or external voltage VDDP can be obtained.

Such bandgap reference voltage circuits are implemented anyway in many common integrated circuits. Also—derived thereof—the generation of a reference current I1 using an operational amplifier and a first resistor R1 is common to many integrated circuits. Therefore, the circuit part comprising the regulation circuit 110, the first transistor M2 and the first resistor R1 to generate the reference current I1 do not necessarily have to be implemented additionally but may simply be used as part of embodiments of the circuit 100, 200, 300, and 400 and of embodiments of the protection circuit 600 and 700. Thus, the generation of the reference voltage Vref, the regulation circuit 110, the first transistor M2 and the first resistor R1 are not relevant for the total current/area balance.

Embodiments of the circuit show no or at least a reduced temperature dependency, process dependency and no or at least a reduced dependency on the comparator current. Additionally, embodiments of the circuits are extremely area-saving and current-saving.

The embodiment 700 can also be referred to as a high precision, area- and current-saving voltage level detection circuit for overvoltage protection of integrated circuits with n-channel-series transistor, which do not comprise any external components.

It should be noted that embodiments of a circuit 300, 400 for detecting whether a voltage difference between a first voltage and a second voltage is below a desired voltage difference can comprise embodiments of circuits 100, 200 for providing a desired voltage difference. Furthermore, embodiments of a protection circuit 600, 700 can comprise circuits 300, 400 for detecting whether a voltage difference between a first voltage and a second voltage is below a desired voltage difference.

Although FIGS. 2, 4 and 7 comprise field-effect transistors M1-M7, further embodiments of the circuits 100, 200, 300, 400, 600, 700 may comprise other transistor technologies, for example bipolar transistor technologies. In addition, although, transistors M1, M4 and M5 are enhancement-type n-channel field-effect transistors and transistors M2 and M3 are p-channel enhancement-type field-effect transistors, other types of transistors can be used to achieve the same effects as described before.

Figure 8:
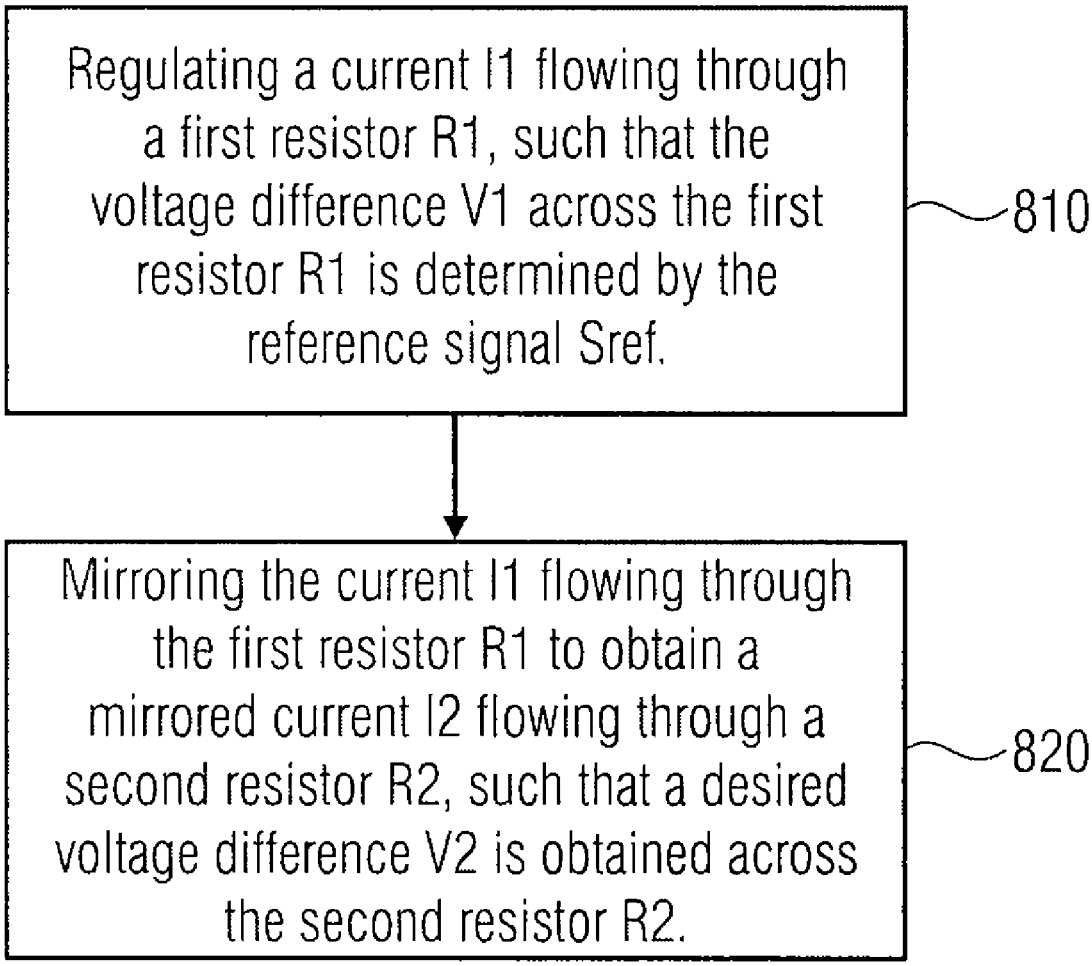
FIG. 8 shows a flow chart of an embodiment of a method for providing a desired voltage difference.

FIG. 8 shows a flow chart of an embodiment of a method 800 for providing a desired voltage difference V2 in dependence on a reference signal Sref, the method comprising the following.

Regulating 810 a current I1 flowing through a first resistor R1, such that the voltage difference V1 across the first resistor R1 is determined by the reference signal Sref.

Mirroring 820 the current I1 flowing through the first resistor R1 to obtain a mirrored current I2 flowing through a second resistor R2, such that a desired voltage difference V2 is obtained across the second resistor R2.

In further embodiments of the method 800 for providing a desired voltage difference V2, the mirroring of the current comprises: Operating a first transistor M2 regulating the current I1 flowing through the first resistor R1; operating a second transistor M3 providing a further current, such that the further current is proportional to the current I1 flowing through the first resistor; and operating a third transistor M4 and a fourth transistor M5, such that the mirrored current I2 flowing through the second resistor R2 is proportional to the further current.

In further embodiments of a method of providing a desired voltage difference, the regulating comprises: Regulating the current flowing through the first resistor R1 by regulating a voltage applied to a control terminal G of the first transistor M2, and regulating a voltage applied to a control terminal G of the second transistor M3, wherein a source terminal S of the first transistor M2 and a source terminal S of the second transistor M3 are connected to each other.

Figure 9:
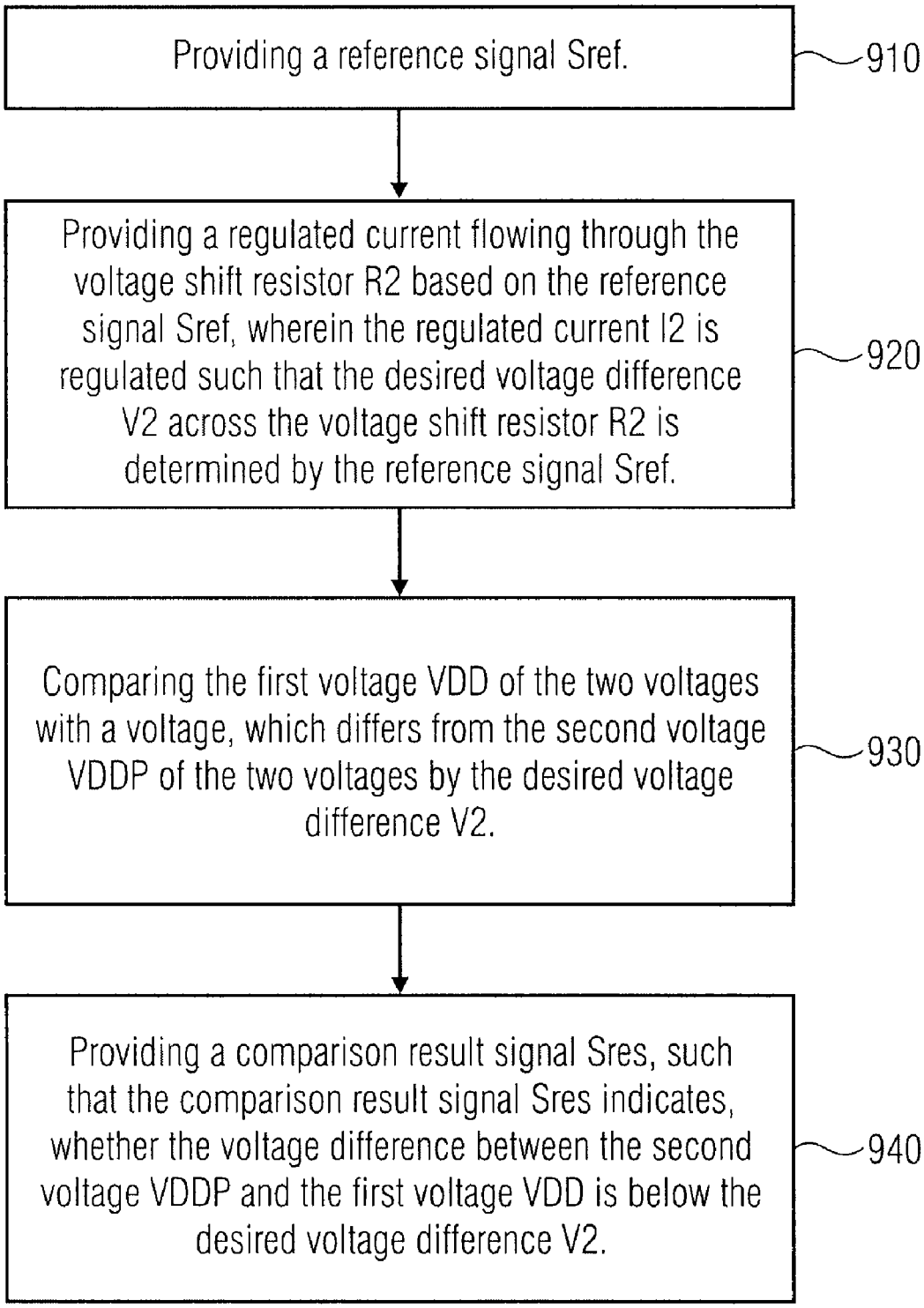
FIG. 9 shows a flow chart of an embodiment of a method for detecting whether a voltage difference between two voltages is below a desired voltage difference.

FIG. 9 shows the flow chart of an embodiment of a method for detecting whether a voltage difference between two voltages is below a desired voltage difference. The method 900 comprises the following.

Providing 910 a reference signal Sref.

Providing 920 a regulated current flowing through the voltage shift resistor R2 based on the reference signal Sref, wherein the regulated current I2 is regulated such that the desired voltage difference V2 across the voltage shift resistor R2 is determined by the reference signal Sref.

Comparing 930 the first voltage VDD of the two voltages with a voltage, which differs from the second voltage VDDP of the two voltages by the desired voltage difference V2.

Providing 940 a comparison result signal Sres, such that the comparison result signal Sres indicates, whether the voltage difference between the second voltage VDDP and the first voltage VDD is below the desired voltage difference V2.

When the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concept disclosed herein and comprehend by the claims that follows.

The invention claimed is:

1. A protection circuit for protecting a first voltage domain, the first voltage domain being coupled to a second voltage domain via a series transistor, wherein a conductor of the first voltage domain is connected to a source terminal of the series transistor and a conductor of the second voltage domain is connected to a sink terminal of the series transistor, the circuit comprising:

a reference circuit configured to provide a reference signal;

a voltage shift resistor connected to the conductor of the second voltage domain;

a current provider configured to provide a regulated current flowing through the voltage shift resistor based on the reference signal, wherein the current provider is configured to regulate the regulated current such that a desired voltage difference across the voltage shift resistor is determined by the reference signal;

a detection circuit being configured to compare a voltage at a first detection circuit input with a voltage at a second detection circuit input to obtain a comparison result signal, wherein the first detection circuit input is coupled to the conductor of the first voltage domain, wherein the voltage shift resistor is coupled between the second voltage domain and the second detection circuit input, such that the voltage at the second detection circuit input differs from a voltage of the second voltage domain by the desired voltage difference, and wherein the detection circuit is configured to provide the comparison result signal, such that the comparison result signal indicates, whether the voltage difference between a voltage of the second voltage domain and the voltage of the first voltage domain is below the desired voltage difference; and a series transistor regulation circuit coupled to the detection circuit to receive the comparison result signal and configured to adapt a voltage applied to a control terminal of the series transistor, such that a load path resistance of the series transistor is increased in case that the comparison result signal indicates that the voltage difference between the voltage of the second voltage domain and a voltage of the first voltage domain is below the desired voltage difference.

2. A protection circuit according to claim 1, wherein the series transistor regulation circuit is configured to adapt a voltage applied to the control terminal of the series transistor, such that the series transistor is operated in its saturation region in case the comparison result signal indicates that the voltage difference between the voltage of the second voltage domain and a voltage of the first voltage domain is below the desired voltage difference.

3. The circuit according to claim 1, wherein the current provider comprises a current provider resistor, wherein the current provider is configured to provide a current flowing through the first resistor based on the reference signal, and wherein the current provider is configured to provide the current flowing through the voltage shift resistor, such that the current is proportional to the current flowing through the first resistor.

4. The circuit according to claim 3, wherein the current provider comprises:

a regulation circuit configured to regulate the current flowing through the current provider resistor, such that a voltage difference across the current provider resistor is determined by the reference signal; and a current mirror, wherein the current mirror is configured to mirror the current flowing through the current provider resistor to determine the regulated current flowing through the voltage shift resistor.

5. The circuit according to claim 4, wherein the current mirror comprises a first current path, a second current path and a third current path, wherein the first current path comprises a first transistor coupled to the current provider resistor to provide the current flowing through the current provider resistor, wherein the third current path comprises a second transistor and a third transistor, wherein the second current path comprises a fourth transistor coupled to the second resistor to provide the mirrored current flowing through the voltage shift resistor, wherein the first and second transistor are configured, such that the current flowing through the third current path is proportional to the current flowing through the current provider resistor, and wherein the third and fourth transistor are configured, such that the mirrored current flowing through the voltage shift resistor is proportional to the current flowing through the third current path.

6. The circuit according to claim 5, wherein the regulation circuit is configured to regulate the current flowing through the first resistor by regulating a voltage applied to a control terminal of the first transistor, and wherein the regulation circuit is further configured to regulate a voltage applied to a control terminal of the second transistor, and wherein a source terminal of the first transistor and a source terminal of the second transistor are connected to each other.

7. The circuit according to claim 6, wherein the regulation circuit is configured to apply the same voltage to the control terminals of the first transistor and the second transistor.

8. The circuit according to claim 5, wherein the regulation circuit is configured to compare a reference voltage of the reference signal and a voltage obtained from a node arranged between the first transistor and the first resistor, and to regulate the voltage applied to the control terminal of the first transistor based on the comparison, such that the difference between the reference voltage and the voltage obtained from the node is reduced below a given threshold.

9. The circuit according to claim 5, wherein a sink terminal of the fourth transistor is connected to the second resistor and wherein a source terminal of the third transistor is connected to a source terminal of the fourth transistor.

10. The circuit according to claim 1, further comprising:

a bandgap reference circuit configured to provide a reference voltage as the reference signal.

* * * * *